US005188369A

United States Patent [19]

Loewenton

[11] Patent Number: 5,188,369

[45] Date of Patent: Feb. 23, 1993

[54] BOARD-TYPE GAME

[76] Inventor: Edward Loewenton, P.O. Box HC132, Morrisville, Vt. 05661

[21] Appl. No.: 745,828

[22] Filed: Aug. 16, 1991

[51] Int. Cl.[5] ..... A63F 3/02

[52] U.S. Cl. ..... 273/258; 273/153 J

[58] Field of Search ..... 273/153 J, 258, 260, 273/261, 262, 255, 264, 282

[56] References Cited

U.S. PATENT DOCUMENTS

| | | | |
|---|---|---|---|
| 566,307 | 8/1896 | Goos | 273/258 |
| 1,204,246 | 11/1916 | Carter | 273/260 |
| 1,396,425 | 11/1921 | Harlow | 273/260 |
| 1,595,285 | 8/1926 | Bevan | 273/282 |

FOREIGN PATENT DOCUMENTS

| | | | |
|---|---|---|---|
| 3864 | of 1904 | United Kingdom | 273/262 |
| 2173707 | 10/1986 | United Kingdom | 273/260 |

OTHER PUBLICATIONS

The Way To Play by the Diagram Group, pp. 42, 58-59, Paddington Press Ltd., 1975.

*Primary Examiner*—Benjamin H. Layno

*Attorney, Agent, or Firm*—Robert F. Goldberg; Peter F. Corless

[57] ABSTRACT

The invention provides a board-type apparatus and method for playing a game. The game of the invention can be played by two, three or four persons. The apparatus of the invention comprises a plurality of defined positions on a game playing board, said positions arranged in a regular pattern whereby playing pieces can be moved from one position to another position by jumping one playing piece over a playing piece adjacently positioned relative to said jumping playing piece, said plurality of defined positions including a single primary position, and the number of said defined positions being greater than the number of said playing pieces.

20 Claims, 5 Drawing Sheets

BOARD-TYPE GAME

FIELD OF THE INVENTION

The present invention relates to a board-type game apparatus and method for playing a game.

SUMMARY OF THE INVENTION

The apparatus of the invention comprises a plurality of defined positions on a game playing board, said positions arranged in a substantially regular pattern whereby playing pieces can be moved from one position to another position by jumping one playing piece over a playing piece adjacently positioned relative to said jumping playing piece, a primary place located among said pattern of defined positions, the number of said defined positions being greater than the number of said playing pieces. Preferably the primary place is located at about the center of the pattern of defined board positions. More preferably the primary place is a single defined position located at the center of the pattern.

The board positions preferably are adapted to receive the playing pieces. Thus, the defined positions can be openings in the playing board. While such openings and the playing pieces may be a variety of shapes such including square and rectangular, preferably the board positions are round shaped openings and the playing pieces are correspondingly cylindrically shaped to enable releasable insertion of the pieces in the round board openings.

The regular pattern of positions preferably is a square-shaped grid. Preferably there are a total of eighty-one defined positions with nine positions aligned along each side of the grid, i.e., nine rows of nine openings comprising the grid.

Typically four separate groups of playing pieces are used, each group marked to be visually distinguishable from the other groups of pieces. Typically there are nine playing pieces in each group.

The game of the invention is suitable for play by two, three or four players.

BRIEF DESCRIPTION OF THE DRAWING

A more complete understanding of the invention may be provided by reference to the accompanying Drawing in which like reference numbers refer to like elements throughout the various figures.

DESCRIPTION OF THE PREFERRED EMBODIMENTS

The game of the invention can be characterized at least in part as a game that imposes few restrictions on the movement of a player's playing pieces; and as a game that provides a sudden change in rules upon the movement of a playing piece into the primary place.

Figure 1:
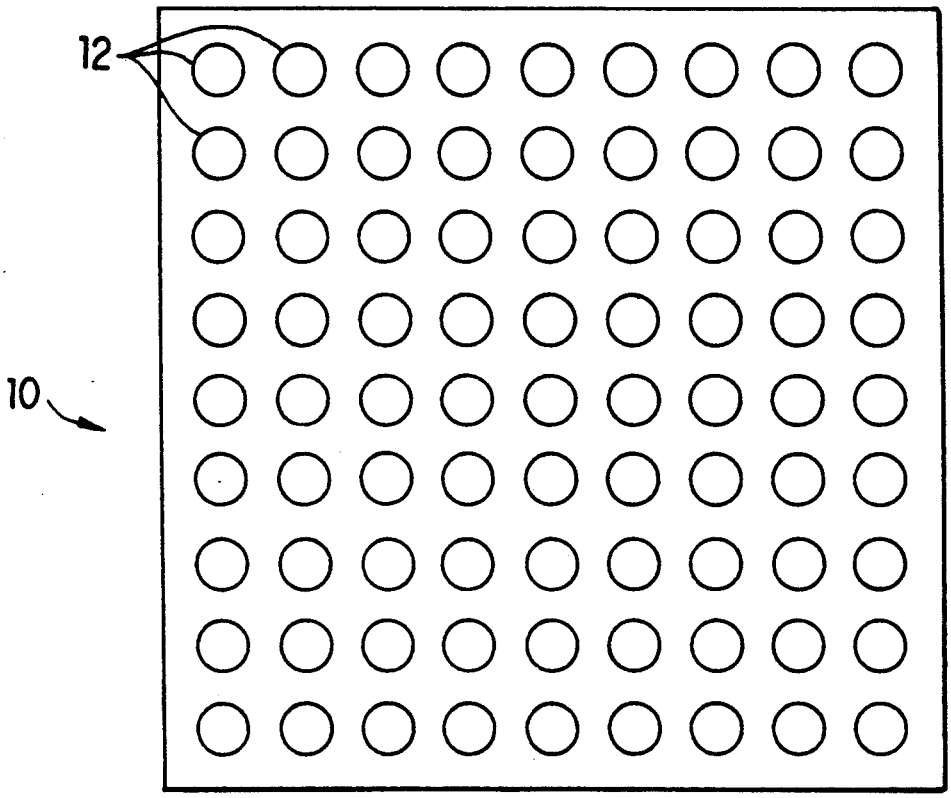
FIG. 1 depicts an above view of a preferred board apparatus of the invention.
Figure 2:
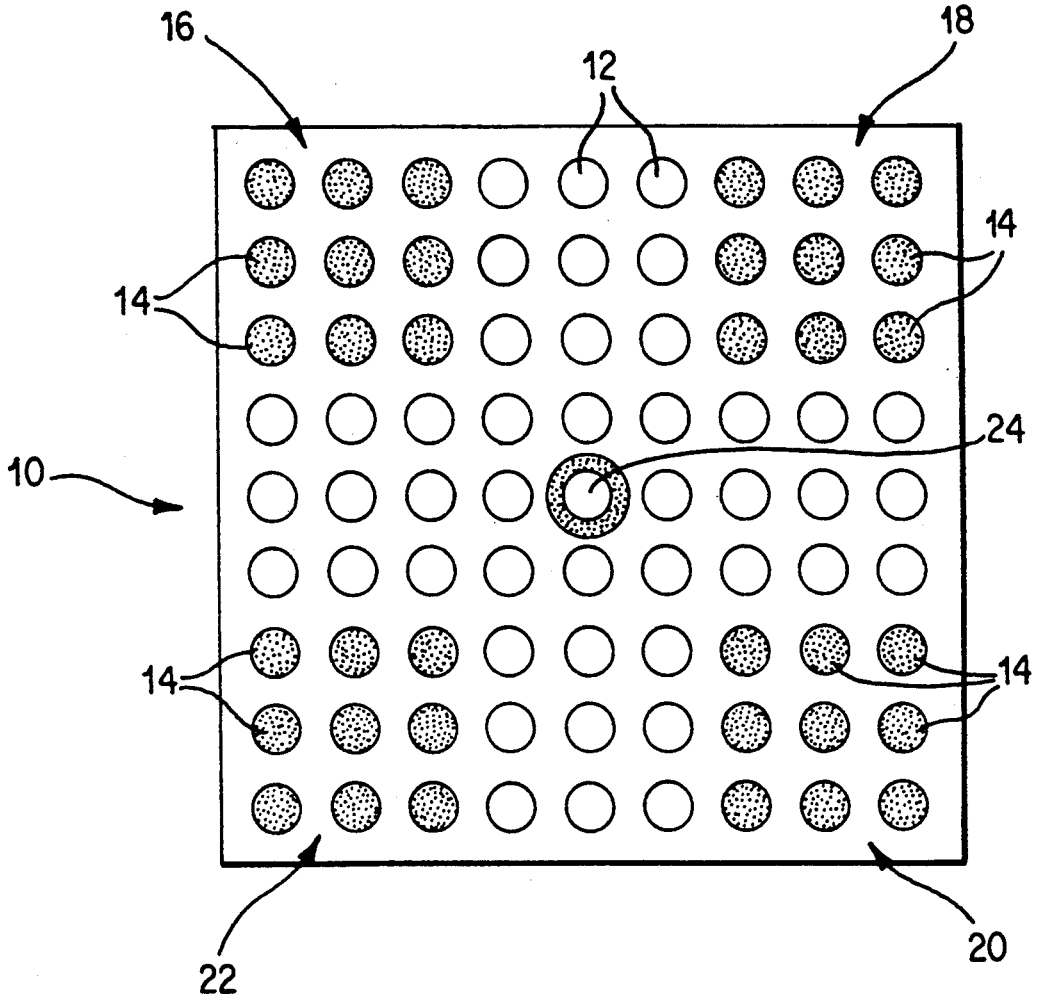
FIG. 2 depicts an above view of a preferred board apparatus and playing pieces.

Referring now to the Drawing, FIGS. 1 and 2 show the apparatus of the invention. Board 10 comprises a plurality of board positions 12 which are adapted to receive playing pieces 14. Preferably board 10 has eighty-one positions 12 arranged in a nine hole-by-nine hole grid as depicted in FIGS. 1 and 2.

Four different groups of playing pieces 16, 18, 20 and 22 are employed. For a playing board that has eighty-one defined positions each such group preferably comprises nine playing pieces. Each such group is preferably marked so as to be visually distinguishable from each of the other group of playing pieces. A preferred marking means is to color each group 16, 18, 20 and 22 different colors, for example coloring group 16 pieces red; coloring group 18 pieces purple; coloring group 20 pieces green; and coloring group 22 pieces blue. When the game apparatus is initially arranged for play, each group of playing pieces 16, 18, 20 and 22 is placed in a separate group of nine corner board positions as shown in FIG. 2. Each such group of positions is referred to herein as the "nine corner positions".

While the invention is generally described herein with reference to an eighty-one position playing board and nine playing pieces per group of pieces, it should be appreciated that the invention encompasses boards having defined positions and groups of playing pieces of different numbers. For example, a board comprising one hundred defined positions arranged in a grid of ten rows with each row comprising ten defined positions. Also suitable will be a board comprising one hundred and twenty-one defined positions where the positions are arranged in a grid of eleven rows and each row comprising eleven defined positions.

The game of the invention is preferably played as follows. When the game is played by four persons, each player is assigned a single group of pieces 16, 18, 20 or 22. A player may only move pieces of the group assigned to the player. The players take sequential turns by each player moving a single piece 14. A "round" is intended to mean herein as a completion of a single turn by each player of the game of the invention. A "moving player" is intended to mean herein a player who is moving a piece 14 during that player's turn.

Figure 3:
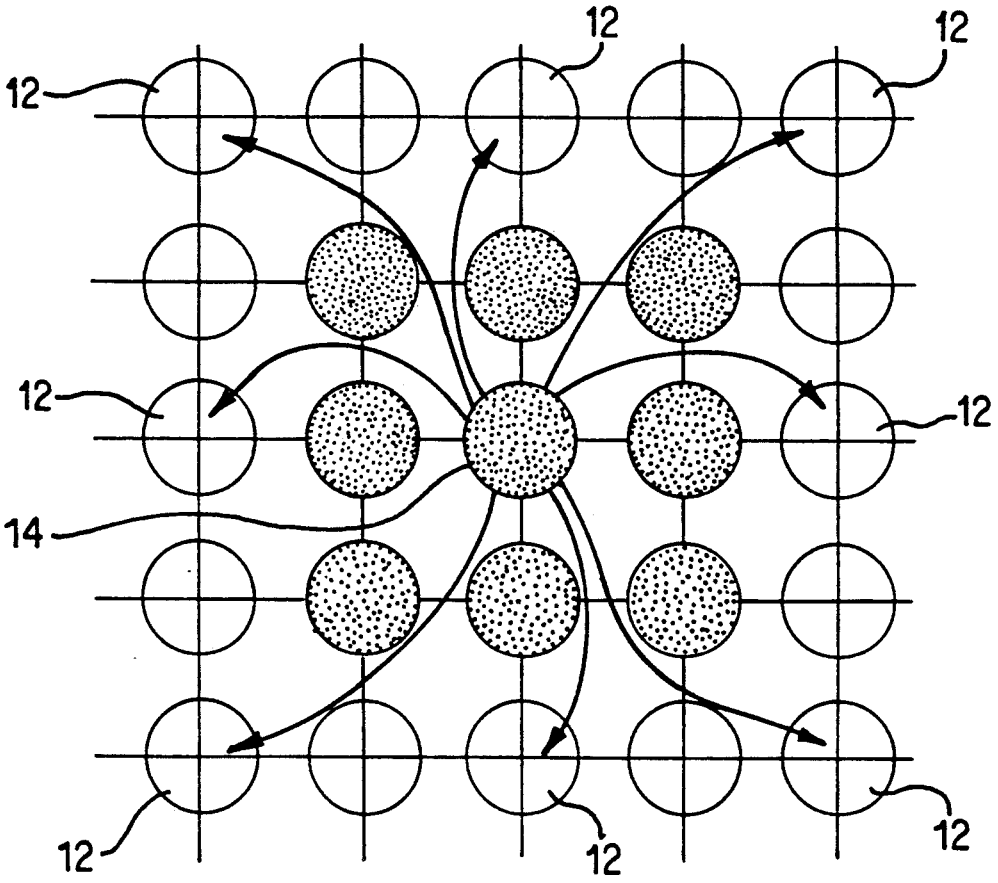
FIG. 3 depicts moves of playing pieces that are permitted.

Pieces 14 are moved by jumping one piece 14 over an adjacently positioned piece 14 into a position 12 that is vacant of any playing pieces 14 (referred to herein as a "vacant position 12"). As shown in FIG. 3, it is permissible to jump over playing pieces into a vacant position 12 in the forward, backward, lateral or diagonal directions relative to the piece 14 that is being moved.

Figure 4A:
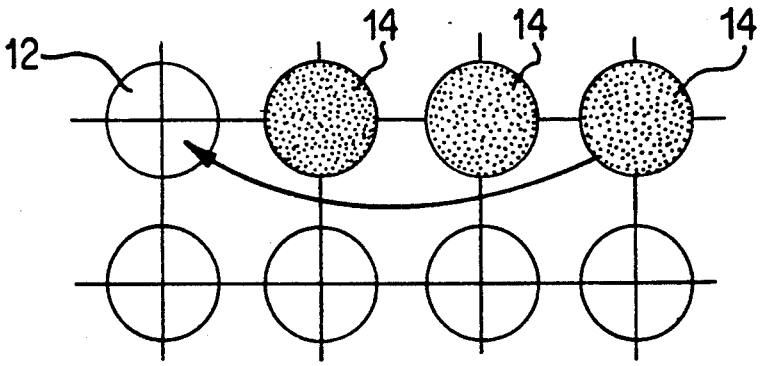
FIGS. 4(*a*), 4(*b*) and 4(*c*) depict moves of playing pieces that are not permitted.
Figure 4B:
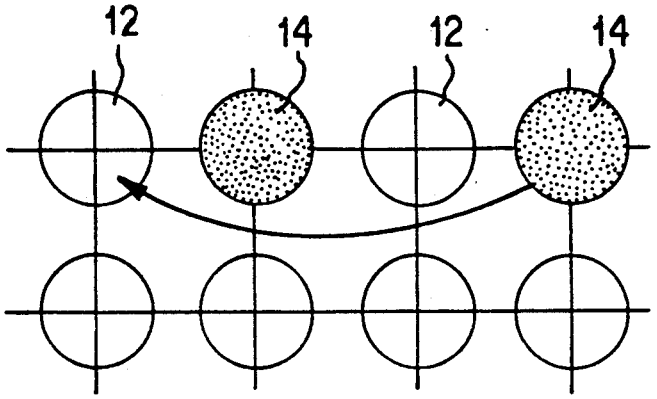
Figure 4C:
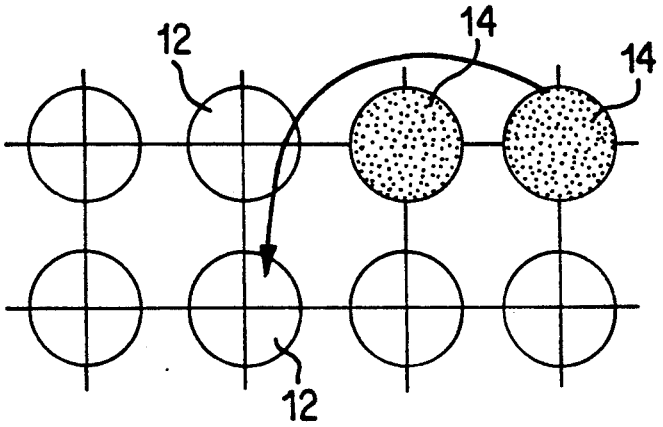

FIGS. 4(*a*), 4(*b*) and 4(*c*) show movements of pieces 14 that are not permitted according to preferred embodiments of the invention. As depicted in FIG. 4(*a*), a piece 14 cannot be jumped over two or more adjacent pieces in a single jump. A piece 14 can only jump over a single adjacent piece 14 into a vacant position 12.

As depicted in FIG. 4(*b*), a piece 14 cannot be jumped over an intervening vacant position 12. As shown in FIG. 4(*c*), it is not permitted to move piece 14 to a vacant position 12 wherein a a straight line is not formed by the vacant position 12, the moving piece 14 and the playing piece 14 adjacent to said moving piece.

Figure 5:
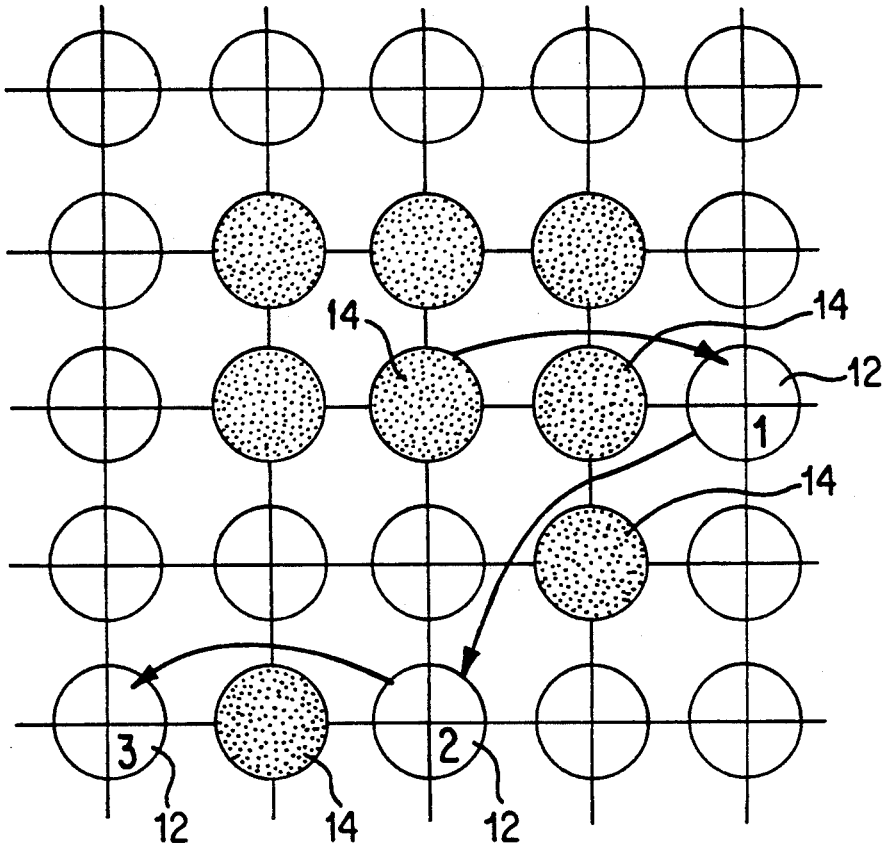
FIG. 5 depicts permitted combination jumps.

As depicted in FIG. 5, a player may move a single piece 14 by means of combining several jumps in the same direction or in different directions. A player need not make all possible jumps of adjacent playing pieces during a single turn. However, it is not permissible to make such a combination jump that returns a piece 14 to same the position 12 where that piece 14 was located at the start of the player's turn.

The moving player may elect to remove from play (i.e, remove from board 10 and any further participation in the game) an adjacent playing piece that has been jumped by the moving player's piece. The decision to remove a jumped piece 14 is made at the sole discretion of the moving player. The removed piece 14 can either be a piece 14 from the group of pieces belonging to the moving player or belonging to another player. However, if the moving player makes a combination jump, i.e., jumps over greater than one piece 14 during his or her turn, the moving player may remove only the last piece 14 that was jumped.

A player may not remove another player's piece 14 by jumping back over that playing piece after the moving player has already jumped at least one time over the piece during that turn. If a piece 14 is to be removed by the moving player, the piece must be removed the first time it is jumped during that turn.

To win the game of the invention, a player must do two things: (1) move one of the player's pieces into the primary place 24 of board 10, and (2) remain in said primary place 24 for two consecutive rounds after moving therein, said two rounds referred to herein as Special Round One and Special Round Two. Once a piece 14 has been moved into primary place 24, and for any turn that commences with the piece in place 24, the playing piece is referred to as the "King Piece"; and the player to whom the King Piece belongs is referred to as the "King".

If a player has moved a piece 14 into primary place 24, there are two ways such a King Piece can be removed from place 24. First, another player can jump the King Piece and remove it from play. Second, the King may elect to move the King Piece from place 24. However, once a King removes his or her King Piece 14 from place 24, the King cannot return the piece to primary place 24 during that same turn.

During Special Round One (i.e, the round immediately commencing immediately after the turn where a player has moved a piece 14 into place 24), the other players may only remove from play the King's playing pieces and may not remove from play pieces 14 that do not belong to the King.

During Special Round Two (i.e., the round commencing after the King Piece has remained in place 24 for the duration of Special Round One), the following provisions apply. The King may move the King Piece from place 24 to jump and remove as many pieces 14 as can be permissibly jumped in a combination jump in a single turn; i.e., the King Piece is not required to stop after jumping and removing a piece 14. Also during Special Round Two, other players may remove as many pieces 14 belonging to the King, including the King Piece, as such other player can jump in a single turn; i.e., such other players are not required to stop their respective turns after jumping and removing a piece 14 belonging to the King. Moreover, other players are not required to remove all the pieces 14 of the King they jump during this round, and are permitted to remove only those pieces 14 they elect to remove. Also during Special Round Two, players other than the King may only remove from play the King's playing pieces and may not remove from play pieces 14 that do not belong to the King.

If the King Piece remains in primary place 24 for the duration of both Special Round One and Special Round Two, the King wins the game.

If the King Piece moves or is removed by another player from place 24 during either Special Round One or Special Round Two, the game continues.

A player who cannot move any of his or her pieces, i.e., cannot jump any adjacent pieces, is considered "disabled" and must resign from the game at that time. A player is also considered disabled and must resign from the game if the player's only available moves during the course of two turns involves moving the same piece 14 from a first position 12 to another position 12 and then back to said first position. A player is also considered disabled and must resign from the game if the player's only available moves during the course of two turns involves moving one or more pieces 14 along a single, straight line of positions 12.

If all players but one have become disabled and resigned from the game, the remaining player is permitted one turn to move into primary place 24. If such remaining player is unable to move into place 24 during a single turn after the last player becomes disabled, there is no winner and the game is a draw.

A disabled player's pieces 14 remain on board 12 after the player resigns and may be used by other players as a means of movement, i.e., to jump over.

If there are only two players, each player may elect to play with two groups of playing pieces. Preferably the player's pieces should be on the same side of board 10 rather than diagonally opposite. For three person play, preferably each player uses a single group of nine playing pieces.

The invention has been described in detail with reference to the preferred embodiments thereof. However, it will be appreciated that those with skill in the art, upon consideration of this disclosure, may make modifications within the spirit and scope of the invention.

What is claimed is:

1. A method for players to play a game, the game played according to rules including a first set of predetermined rules of movement of playing pieces of the game and a second set of predetermined rules of movement of playing pieces of the game, said first and second set of rules of movement being different, the method comprising:

(a) providing a game apparatus comprising a plurality of defined positions, a plurality of playing pieces positioned on a portion of the total number of said defined positions, and a primary place positioned among said defined positions, said first set of predetermined rules effective prior to a playing piece moving onto the primary place to end a player's turn; and (b) moving a playing piece onto the primary place to end a player's turn, wherein said second set of predetermined rules are effective upon said moving of the playing piece onto the primary place.

2. The method of claim 1 where said defined positions are arranged in a substantially regular pattern and the playing pieces are moved from one position to another position by jumping one playing piece over a playing piece adjacently positioned relative to said jumping playing piece.

3. The method of claim 1 where a playing piece belonging to one player is positioned on said primary place, and other players removing from play of the game only playing pieces belonging to said player having a piece positioned on said primary place.

4. The methods of claim 1 further comprising jumping a first player's playing piece over a playing piece belonging to a second player, wherein said first player after said jumping may remove from play of the game said playing piece belonging to said second player, provided a playing piece is not positioned on said primary place.

5. The method claim 1 where said primary place is located in the center of said grid of positions.

6. The method claim 1 where said primary place is a single defined position of said plurality of positions.

7. The method claim 1 where there are a total of eighty-one defined positions.

8. A method for players to play a game, comprising:

(a) providing a game apparatus comprising a plurality of defined positions and a primary place located among said plurality of positions, said game further comprising a plurality of playing pieces positioned on a portion of said defined positions;

(b) moving a playing piece onto said primary place; and (c) winning the game by maintaining the playing piece in said primary place for two rounds of the game.

9. The method of claim 8 where the game is played according to the rules including a first set of predetermined rules of movement of playing pieces of the game and a second set of predetermined rules of movement of playing pieces of the game, said first and second set of rules of movement being different, said first set of predetermined rules effective prior to a playing piece moving onto the primary place to end a player's turn, and said second set of predetermined rules are effective upon moving and maintaining the playing piece onto the primary place.

10. The method claim 8 where there are a total of eighty-one defined positions.

11. The method of claim 10 where said primary place is a single defined position of said eighty-one defined positions.

12. The method of claim 8 further comprising jumping a first player's playing piece over a playing pieces belonging to a second player, wherein said first player after said jumping may remove from play of the game said playing piece belonging to said second player, provided a playing piece is not positioned in said primary place.

13. The method of claim 8 where a playing piece belonging to one player is positioned on said primary place, and other players removing from play of the game only those playing pieces belonging to said player having a piece positioned on said primary place.

14. The method of claim 8 where the plurality of defined positions are arranged in a substantially regular pattern whereby playing pieces can be moved from one position to another position by jumping one playing piece over a playing piece positioned adjacently to said jumping playing piece.

15. A method for players to play a game, comprising:

(a) providing a game apparatus comprising a plurality of defined positions and a primary place located among said plurality of positions, said game further comprising a plurality of playing pieces positioned on a portion of said defined positions;

(b) moving a playing piece onto said primary place, whereupon other players may remove from play of the game only those playing pieces belonging to said player having a piece positioned on said primary place; and (c) winning the game by maintaining the playing piece in said primary place.

16. The method of claim 15 where the game is played according to the rules including a first set of predetermined rules of movement of playing pieces of the game and a second set of predetermined rules of movement of playing pieces of the game, said first and second set of rules of movement being different, said first set of predetermined rules effective prior to a playing piece moving onto the primary place to end a player's turn, and said second set of predetermined rules are effective upon moving and maintaining the playing piece onto the primary place.

17. The method claim 15 where the game is won by maintaining the playing piece in said primary place for two rounds of the game.

18. The method claim 16 where the game is won by maintaining the playing piece in said primary place for two rounds of the game.

19. The method claim 15 where there are a total of eighty-one defined positions.

20. The method of claim 15 further comprising jumping a first player's playing piece over a playing piece belonging to a second player, wherein said first player after said jumping may remove from play of the game said playing piece belonging to said second player, provided a playing piece is not positioned in said primary place.

* * * * *